United States Patent [19]

Rohde et al.

[11] Patent Number: 4,711,114

[45] Date of Patent: Dec. 8, 1987

[54] METHOD OF AND APPARATUS FOR THE PRODUCTION OF WIDE STRIP

[75] Inventors: Wolfgang Rohde, Dormagen; Manfred Kolakowski, Erkrath, both of Fed. Rep. of Germany

[73] Assignee: SMS Schloemann-Siemag AG, Dusseldorf, Fed. Rep. of Germany

[21] Appl. No.: 861,084

[22] Filed: May 8, 1986

[30] Foreign Application Priority Data

May 11, 1985 [DE] Fed. Rep. of Germany ..... 3517090

[51] Int. Cl.[4] ..... B21B 13/08

[52] U.S. Cl. ..... 72/234; 72/203

[58] Field of Search ..... 72/203, 229, 234

[56] References Cited

U.S. PATENT DOCUMENTS 2,214,618 9/1940 Kenyon et al. ..... 72/203
2,348,283 5/1944 Dolan ..... 72/203
4,494,395 1/1985 Brettbacher et al. ..... 72/203

FOREIGN PATENT DOCUMENTS 75729 10/1949 U.S.S.R. .
719715 3/1980 U.S.S.R. .
1079317 1/1983 U.S.S.R. .

*Primary Examiner*—W. D. Bray
*Attorney, Agent, or Firm*—Karl F. Ross; Herbert Dubno

[57] ABSTRACT

A method of and an apparatus for producing wide strip at increased production rates connects the individual lengths of rough-rolled or continuously caused rough strip end to end to form a continuous band which is passed at constant speed through the working rolls of a hot-rolling finishing line. Downstream of the hot-rolling stands, the wide hot-rolling band is subdivided into lengths of wide strip which can be coiled on separate coilers.

11 Claims, 4 Drawing Figures

METHOD OF AND APPARATUS FOR THE PRODUCTION OF WIDE STRIP

BACKGROUND OF THE INVENTION

Our present invention relates to a method of and an apparatus for the rolling of prerolled lengths of strip into wide strip and, more particularly, to the production of wide strip by a rolling process in which prerolled lengths of strip, also referred to as rough-rolled strip, is passed through a finishing line comprising a plurality of hot-rolling stands so as to be hot rolled in the formation of so-called wide strip. Thus the invention relates to a rolling process in which rough-rolled strip is hot rolled to wide strip in a finishing line comprising a plurality of hot-rolling stands.

BACKGROUND OF THE INVENTION

It is a common practice to hot-roll wide strip in a plurality of roughing hot-rolling lines, determining the rolling operation in a finishing line having a plurality of hot-rolling stands.

The prerolled strip or rough-rolled strip can have a thickness of 25 to 60 mm as it leaves the last of the rough-rolling lines and is then fed, usually directly, onto the finishing line and the hot-rolling stands thereof.

Before this strip is fed into the nip of the first pair of working rolls of the finishing line, the leading edge is usually cropped off and at this point it has customarily already left the last roughing line.

Upon introduction into the finishing line, the strip is compelled to move at a so-called introduction speed which is generally of the order of 1 m/s for the rather small thicknesses of 2 to 3 mm of the finished strip. This speed is effectively a limitation on the discharge rolling speeds of the lines upstream of the finish-rolling line where higher velocities are frequently desired, e.g. 11 m/s or above.

When the speed of the strip entering the finishing line is too high, the impact of the leading edge of the strip on the conveyor rolls defining the transport path causes an acceleration of these rolls or a deflection by these rolls with the result that the lengths of strip become canted with respect to the desired transport path and can create problems upon entering the finishing line.

As the strip leaves the finishing line, it passes with a velocity of say 11 m/s or with reduced acceleration via the conveyor rollers of the transport path to the strip coiler. The strip coiler then provides the limit of the velocity of the strip in this region.

The transport path can be constructed to allow acceleration of the strip.

With acceleration of the strip through the finishing line, the final rolling temperature in the last rolling stand of this line is increased. Such an increase in the final rolling temperature is generally undesirable.

In conventional mill operations, the increase in the final rolling temperature is compensated by the constant temperature drop in the hot-rolled strip with increasing rolling time. By a correct selection of the acceleration, the temperature rise resulting from the acceleration can be compensated by the temperature drop with increasing rolling time and this acceleration can therefore be referred to as the temperature-determined acceleration.

The productivity of a finishing line in terms of the mass of material outputted per unit time is limited by the maximum possible input speed of the strip, for example, 10 to 11 m/s, and the maximum possible temperature-dependent acceleration. An increase in productivity is possible when the acceleration is raised above the temperature dependent acceleration. This technique is known and has been practiced, but its use requires further cooling in the finishing line and may be undesirable for other reasons as well.

Modern rough-rolling line operations have recognized the importance of a constant input temperature for the finishing line and various techniques have been used to achieve this constant input temperature. These include the use of a coil box, heat-reducing hoods, a throughflow or tube furnace, or even the intervention of pusher-type furnaces.

Even with these approaches, the input speed of the strip to the finishing line is limited by the velocity of the strip until it is engaged in the coiler. When efforts are made to increase the velocity of the strip to increase productivity, unacceptably high final rolling temperatures with forced cooling can scarcely be avoided.

OBJECTS OF THE INVENTION

It is, therefore, the principal object of the present invention to provide an improved method of hot-rolling wide strip which allows an increase in productivity without the drawbacks outlined above.

Another object of the invention is to provide an improved method of hot-rolling steel strip with high dimensional uniformity and uniform grain and lattice structure by comparison with earlier approaches.

It is also an object of the invention to provide a method of hot-rolling strip which not only permits productivity to be increased but also allows a reduction in the power demand for operating the system.

Still another object of the invention is to provide an improved apparatus for carrying out the method, i.e. for the economical hot rolling of wide strip with high dimensional and structural uniformity.

SUMMARY OF THE INVENTION

These objects and others which will become apparent hereinafter are attained, in accordance with the present invention, by connecting the successive rough-rolled lengths of strip end to end to form an endless band which is finish rolled at constant speed and from which the individual lengths of finish-rolled wide strip can be separated.

Because the individual lengths of rough-rolled or prerolled strip are connected together, the action of a leading edge of an oncoming length of strip no longer plays a significant role in speed limitation and thus an important limitation on the velocity of the strip entering the nip between the upstream working rolls of the upstream stand of the finishing line can be eliminated.

The entire finishing line can operate with a constant substantially higher production speed and because of the resulting higher transformation heat, the input temperature of the continuous band can be reduced so that it is identical to the existing temperature of the band and of a conventional apparatus.

Thus we provide a method of producing wide strip, which comprises the steps of:

(a) feeding a succession of roughed-out lengths of strip along a path to a finish-rolling line having a plurality of rolling stands therealong;

(b) affixing the successive lengths end to end before the lengths enter the stands of the finish-rolling line to form a continuous band;

(c) finish rolling the strip to a given thickness at a constant velocity by passing the band through the stands of the line; and (d) thereafter separating the lengths from one another.

The lengths can be affixed end to end in step (b) by welding contiguous edges of adjoining ends together over part of the width of the band or even over the entire width.

The lengths can also be affixed end to end in step (b) by interfitting complementary formations, e.g. dovetails, along contiguous edges of adjoining ends in a formfitting interconnection.

The method thus provides a number of important advantages:

A constant high production velocity is possible with respect to the basic length of the rough-rolled strip since the rolling time is reduced and thus, in a given period of time, the finishing line can output a larger quantity of wide strip.

The input temperature in the finishing line can be lowered significantly.

The finishing line does not require any acceleration to maintain a constant temperature.

The constant temperature in each stand of the finishing line improves the conditions for precise thickness control and uniformity of the grain or lattice structure of the rolled product.

Since the intervening cooling for compensating intermediate acceleration is eliminated, the detrimental effect of such cooling on thickness control is likewise excluded.

The rolling temperatures achieve steady state operating values so that detrimental effects on the cross section of the strip resulting from fluctuating temperature conditions in the rolls can be avoided.

The grain structure and internal metallic conformation of the finished product is far more uniform because of the constant final rolling temperature than is the case with conventional hot rolling operations.

According to another aspect of the invention, a flying separator is provided downstream of the finishing rolls which can move along with the outcoming strip to subdivide the continuous band into individual lengths, while a deflector can be provided downstream of the separator for directing the individual lengths onto the strip coilers. The invention has been found to be best applicable to rough strip produced by continuous casting.

Thus the apparatus can comprise a means for feeding a succession of roughed-out lengths of strip along a path to a finish-rolling line having a plurality of rolling stands therealong;

means for affixing the successive lengths end to end before the lengths enter the stands of the finish-rolling line to form a continuous band;

means for finish rolling the strip to a given thickness by passing the band through the stands of the line; and means for thereafter separating the lengths from one another.

The means for affixing the successive lengths end to end can include means for welding the lengths together over all or at least part of the width of the band.

Alternatively the means for affixing the successive lengths end to end can include means for providing complementary formations, e.g. dovetails, along contiguous edges of adjoining ends and interfitting the formations in a formfitting interconnection.

The wide-strip hot-rolling line of the invention can comprise:

a plurality of wide-strip hotrolling stands along a transport path;

feed means along the path upstream of the stands for feeding a succession of roughed-out lengths of strip along the path to the stands;

means along the path between the feed means and the stands for affixing the successive lengths end to end before the lengths enter the stands to form a continuous band which is rolled in the stands;

a flying divider downstream of the stands along the path for separating the lengths of wide strip forming the band from one another; and at least one strip coiler downstream of the divider along the path receiving the lengths of wide strip and coiling them up.

When a plurality of coilers are provided downstream of the divider, the apparatus further comprises a strip deflector between the coilers and the divider for selectively feeding successive strips to different coilers.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
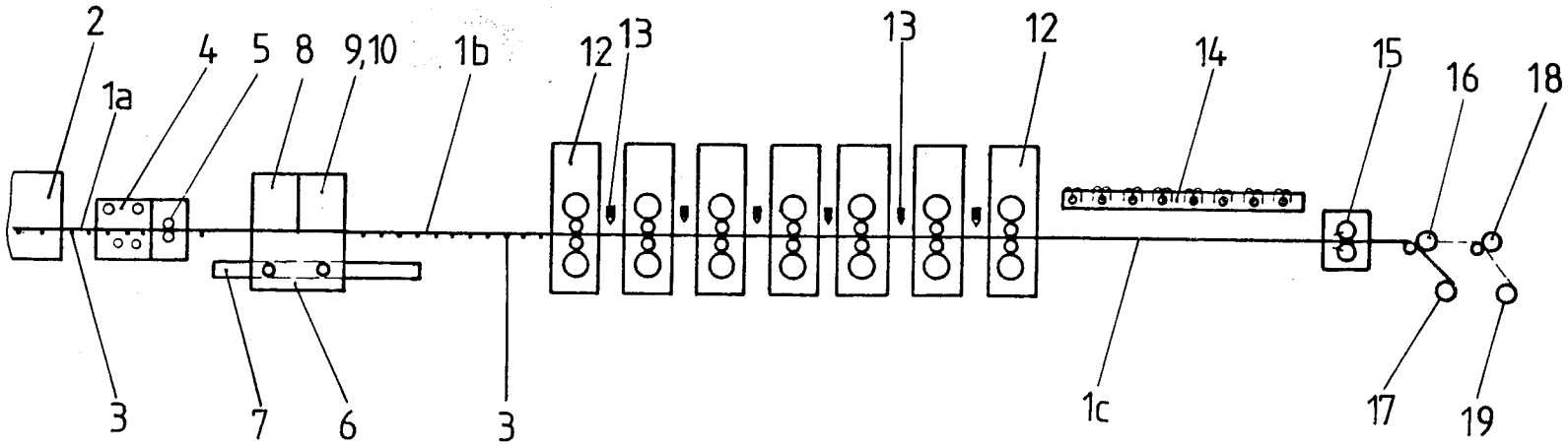
FIG. 1 is a highly diagrammatic side elevational view of a finishing rolling line according to the invention.

From a rough-rolling line (or a series of rough-rolling lines) or direct from a continuous casting apparatus, a succession of roughed-out lengths 1*a*, 1*b* of metal strip are fed in succession from a furnace 2 in which they are held at the rolling temperature onto a roller conveyor 3 defining a transport path for the hot-rolling finishing mill.

The rough strip is first passed through a conventional descaler 4 which may include a scarfing stage and then through a drive 5 shown as a pair of driven rolls to a device 6 for connecting the trailing end of the earlier strip to the leading end of the following strip in succession.

This connecting device can include a unit which moves with the strip along the transport path to form the connection and then returns to interconnect the next pair of ends arriving at this unit.

Figures 2, 3, 4:
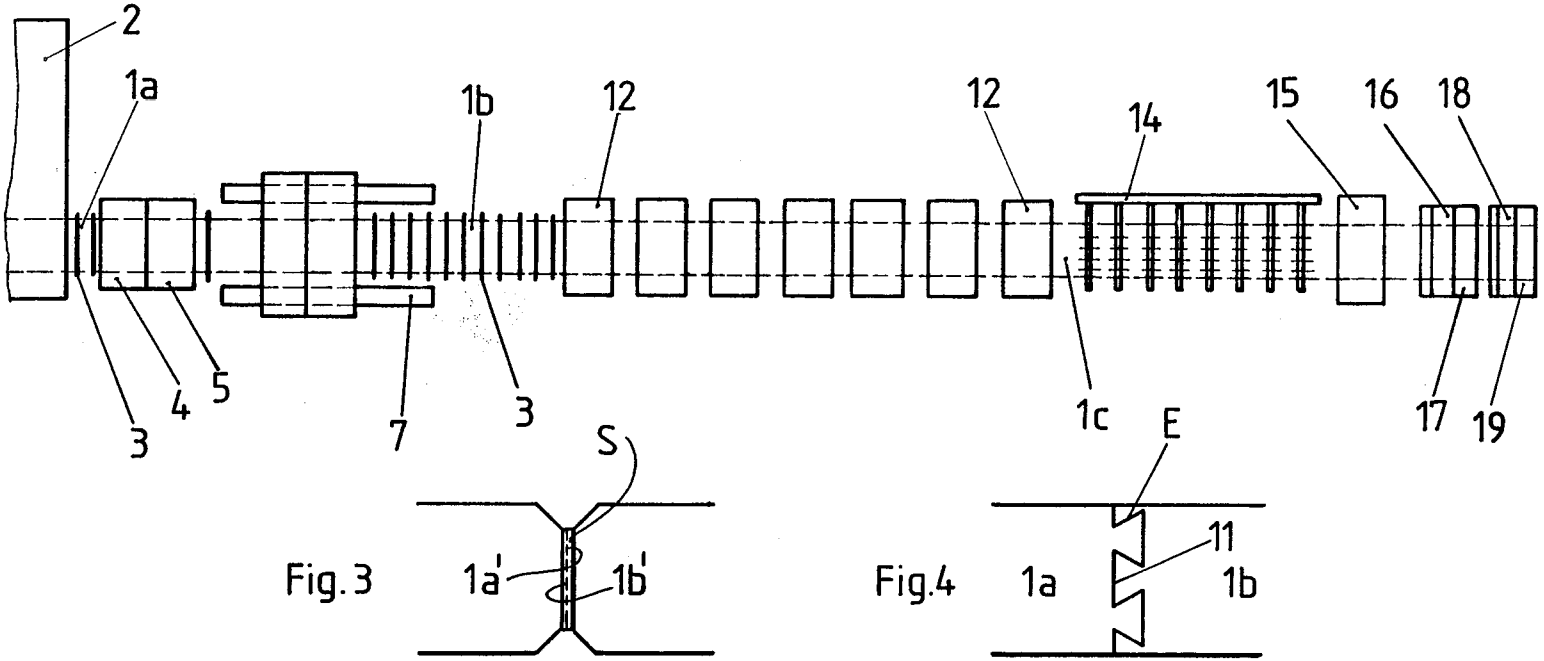
FIG. 2 is a plan view of this finish-rolling line.
FIG. 3 is a diagram showing one method of joining the lengths of strip end to end.
FIG. 4 is a diagrammatic plan view showing another technique for joining the lengths of strip end to end, in accordance with the invention.

As can be seen from FIG. 3, the connection can be formed by providing a butt weld between the strip ends shown at 1*b*′ and 1*a*′, respectively, this weld being represented at S and extending the full width of the strip or only over a portion of the width thereof. The alternative interconnection can be provided as shown in FIG. 4 wherein the ends of the two strips 1*a* and 1*b* to be joined are provided with cutouts of a mating dovetail configuration as shown at 11 and are caused by relative movement of one dovetail tongue into a dovetail groove transversely to the plane of the paper in FIG. 4 to snap into one another and thus form an effective interfit.

As can be seen in FIG. 1, the unit 6 can comprise a cutting device 8 for cropping the leading and trailing edges of the two lengths of strip and a butt welding unit 9. Instead of the welding unit 9, the device 10 can be provided when the cutter 8 forms the dovetail formations for locking these formations together. Devices for cutting across the width of the strip and forming welds between two edges or locking interfitting formations together are known in the art and thus have not been described in greater detail here.

As can be seen from FIG. 3, the adjoining ends of the two lengths of strip can be first chamfered to reduce the cross section along which the weld seam is provided.

The strip now in the form of a continuous band passes at constant speed through the four-high hot rolling stands 12, seven of which are used in the finishing line here shown and cool and spray nozzles 13 can be provided between these stands for preventing the final rolling temperature of the strip from becoming too high. The hot-rolled strip 1c in the form of a continuous band, can then be cooled by a planar or laminar cooling zone 14 to the cooling temperature.

Upstream of the coilers, a flying shear or other divider for cutting the continuous band into appropriate strip lengths can be provided at 15 and this shear can be coordinated to sever the continuous band at the weld locations S or at the form-locked locations E at which the original lengths of strip were joined. A deflector, formed by a pair of rollers 16 and 18 for driving the strip and directing it, can be provided upstream of a plurality of coilers 17 and 19 for selectively directing the individual lengths of hot-rolled wide strip onto these coilers.

We claim:

1. A method of producing wide strip, which comprises the steps of:

(a) feeding a succession of roughed-out lengths of strip along a path to a finish-hot-rolling line having a plurality of rolling stands therealong;

(b) affixing the successive lengths end to end before said lengths enter the stands of said finish-hot-rolling line to form a continuous band;

(c) finish-hot-rolling said strip to a given thickness at a constant velocity by passing said band through the stands of said line; and (d) thereafter separating the lengths from one another.

2. The method defined in claim 1 wherein said lengths are affixed end to end in step (b) by welding contiguous edges of adjoining ends together over at least part of the width of said band.

3. The method defined in claim 2 wherein said lengths are affixed end to end in step (b) by welding said contiguous edges of adjoining ends together over the entire width of said band.

4. The method defined in claim 1 wherein said lengths are affixed end to end in step (b) by interfitting complementary formations along contiguous edges of adjoining ends in a formfitting interconnection.

5. The method defined in claim 4 wherein said interfitting complementary formations are dovetails.

6. An apparatus for producing wide strip, comprising:

means for feeding a succession of roughed-out lengths of strip along a path to a finish-hot-rolling line having a plurality of rolling stands therealong;

means for affixing the successive lengths end to end before said lengths enter the stands of said finish-hot-rolling line to form a continuous band;

means for finish-hot-rolling said strip to a given thickness by passing said band through the stands of said line; and means for thereafter separating the lengths from one another.

7. The apparatus defined in claim 6 wherein said means for affixing the successive lengths end to end includes means for welding said lengths together over at least part of the width of said band.

8. The apparatus defined in claim 6 wherein said means for affixing the successive lengths end to end includes means for welding said lengths together over the width of said band.

9. The apparatus defined in claim 6 wherein said means for affixing the successive lengths end to end includes means for providing complementary formations along contiguous edges of adjoining ends and interfitting said formations in a formfitting interconnection.

10. A wide-strip hot-rolling line comprising:

a plurality of wide-strip hot-rolling stands along a transport path;

feed means along said path upstream of said stands for feeding a succession of roughed-out lengths of strip along said path to said stands;

means along said path between said feed means and said stands for affixing the successive lengths end to end before said lengths enter the stands to form a continuous band which is rolled in said stands;

a flying divider downstream of said stands along said path for separating the lengths of wide strip forming said band from one another; and at least one strip coiler downstream of said divider along said path receiving said lengths of wide strip and coiling them up.

11. The wide-strip hot-rolling line defined in claim 10 wherein a plurality of coilers are provided downstream of said divider, further comprising a strip deflector between said coilers and said divider for selectively feeding successive strips to different coilers.

* * * * *